US009989893B2

(12) United States Patent
Takahashi

(10) Patent No.: US 9,989,893 B2
(45) Date of Patent: Jun. 5, 2018

(54) IMAGE FORMING APPARATUS FOR CONTROLLING INTENSITY OF LIGHT IRRADIATING INTERMEDIATE TRANSFER BODY

(71) Applicant: CANON KABUSHIKI KAISHA, Tokyo (JP)

(72) Inventor: Shun Takahashi, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/497,510

(22) Filed: Apr. 26, 2017

(65) Prior Publication Data

US 2017/0336737 A1 Nov. 23, 2017

(30) Foreign Application Priority Data

May 17, 2016 (JP) ..... 2016-099051

(51) Int. Cl.

| | |
|---|---|
| ***G03G 15/00*** | (2006.01) |
| ***G03G 15/16*** | (2006.01) |
| ***G03G 15/043*** | (2006.01) |
| ***G03G 15/01*** | (2006.01) |

(52) U.S. Cl.

CPC ..... *G03G 15/1605* (2013.01); *G03G 15/0131* (2013.01); *G03G 15/043* (2013.01)

(58) Field of Classification Search

CPC ..... G03G 15/5058; G03G 15/0189; G03G 15/0131; G03G 15/01; G03G 2215/0161

See application file for complete search history.

(56) References Cited

U.S. PATENT DOCUMENTS

2011/0268461 A1* 11/2011 Shirasaki ..... G03G 15/043 399/45

2014/0079443 A1* 3/2014 Nanai ..... G03G 15/5058 399/301

FOREIGN PATENT DOCUMENTS

JP 2007-148080 A 6/2007

OTHER PUBLICATIONS

U.S. Appl. No. 15/400,149, Shun Takahashi, Shinya Suzuki, filed Jan. 6, 2017.

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes a controller configured to compare a threshold value and an output value corresponding to an intensity of light reflected from a detection image, and to detect a color misregistration amount based on a comparison result; an update unit configured to update the threshold value based on a previous output value corresponding to the intensity of the light reflected from the detection image; and an adjustment unit configured to adjust an emission intensity of the light emitting element. The update unit updates, in a case when the emission intensity is adjusted, the threshold value based on the previous output value, a previous emission intensity, and the emission intensity adjusted by the adjustment unit.

6 Claims, 10 Drawing Sheets

IMAGE FORMING APPARATUS FOR CONTROLLING INTENSITY OF LIGHT IRRADIATING INTERMEDIATE TRANSFER BODY

BACKGROUND OF THE INVENTION

Field of the Invention

The present invention relates to a color misregistration correction technique in an image forming apparatus.

Description of the Related Art

An image forming apparatus that forms toner images of different colors on a plurality of a photosensitive members and that forms a color image by transferring these toner images by superimposing them onto another medium is known. In such an image forming apparatus, a position of transfer to a medium shifts from an ideal state due to an influence of a positional variation of parts due to a temperature rise at a time of an image formation or a part tolerance, and by this, a so-called color misregistration can occur. For this reason, the image forming apparatus performs color misregistration correction control. Specifically, a color misregistration amount detection pattern is formed on a medium and a relative positional relationship of each color of a toner image included in the detection pattern is detected to obtain the amount of color misregistration. Then, a position of a toner image formed on each photosensitive member is controlled so that the amount of color misregistration is decreased.

The detection pattern is normally detected by an optical sensor. The optical sensor has a light emitting unit and a light receiving unit, the light emitting unit emits light onto a medium on which the detection pattern is formed, and light receiving unit receives the reflected light, and outputs an analog signal of a level corresponding to the received light intensity. The relative positional relationship of each color can be determined by comparing an analog signal that the light receiving unit outputs to a threshold value and converting it into a digital signal because the intensity of the reflected light reflected by the toner image of the detection pattern and the light reflected from the front surface of the medium on which a toner image is not formed are different. Japanese Patent Laid-Open No. 2007-148080 discloses updating a threshold value for converting an analog signal to a digital signal based on the intensities of reflection from the front surface of an intermediate transfer belt and the detection pattern.

For example, a degree of reflection of light on the front surface of the medium changes due to aging degradation of the medium or adherence of paper dust thereto. The level of the analog signal that the light receiving unit outputs in the color misregistration correction control also changes when the degree of reflection of light changes, and this influences the precision of detection of the detection pattern. Accordingly, the image forming apparatus performs an adjustment of the light intensity that the optical sensor emits. However, the level of the analog signal that the light receiving unit outputs in the color misregistration correction control also changes when adjustment of the light intensity that the optical sensor emits is performed, and this influences the precision of detection of the detection pattern.

SUMMARY OF THE INVENTION

According to an aspect of the present invention, an image forming apparatus includes: a plurality of image forming units configured to form images of different colors; an intermediate transfer body, on which a detection image for detecting a color misregistration amount of the images of different colors is transferred; a light emitting element configured to emit a light for irradiating the intermediate transfer body; a light receiving element configured to receive light reflected from the intermediate transfer body and to output an output value corresponding to an intensity of the reflected light; a controller configured to control the plurality of image forming units to form the detection image, to control the light emitting element to emit light, to control the light receiving element to receive light reflected from the detection image, to compare a threshold value and an output value corresponding an intensity of the light reflected from the detection image outputted by the light receiving element, and to detect the color misregistration amount based on a comparison result of the threshold value and the output value corresponding to the intensity of the light reflected from the detection image; a correction unit configured to correct, based on the color misregistration, relative positions of images of the different colors to be formed by the plurality of image forming units; an update unit configured to update the threshold value based on a previous output value corresponding to the intensity of the light reflected from the detection image outputted by the light receiving element; and an adjustment unit configured to control the light emitting element to emit light based on a plurality of emission intensities, to control the light receiving element to receive light reflected from the intermediate transfer body, to obtain a plurality of output values corresponding to the intensity of the light reflected from the intermediate transfer body outputted by the light receiving element, and to adjust an emission intensity of the light emitting element based on the plurality of output values. The update unit updates, in a case when the emission intensity is adjusted by the adjustment unit, the threshold value based on the previous output value corresponding to the intensity of the light reflected from the detection image outputted by the light receiving element, a previous emission intensity, and the emission intensity adjusted by the adjustment unit.

Further features of the present invention will become apparent from the following description of exemplary embodiments with reference to the attached drawings.

DESCRIPTION OF THE EMBODIMENTS

Exemplary embodiments of the present invention will be described hereinafter, with reference to the drawings. Note, the following embodiment is only an example and the present invention is not limited to the content of the embodiment. Also, for the following drawings, elements that are not necessary for the description of the embodiment are omitted from the drawings.

Figure 1:
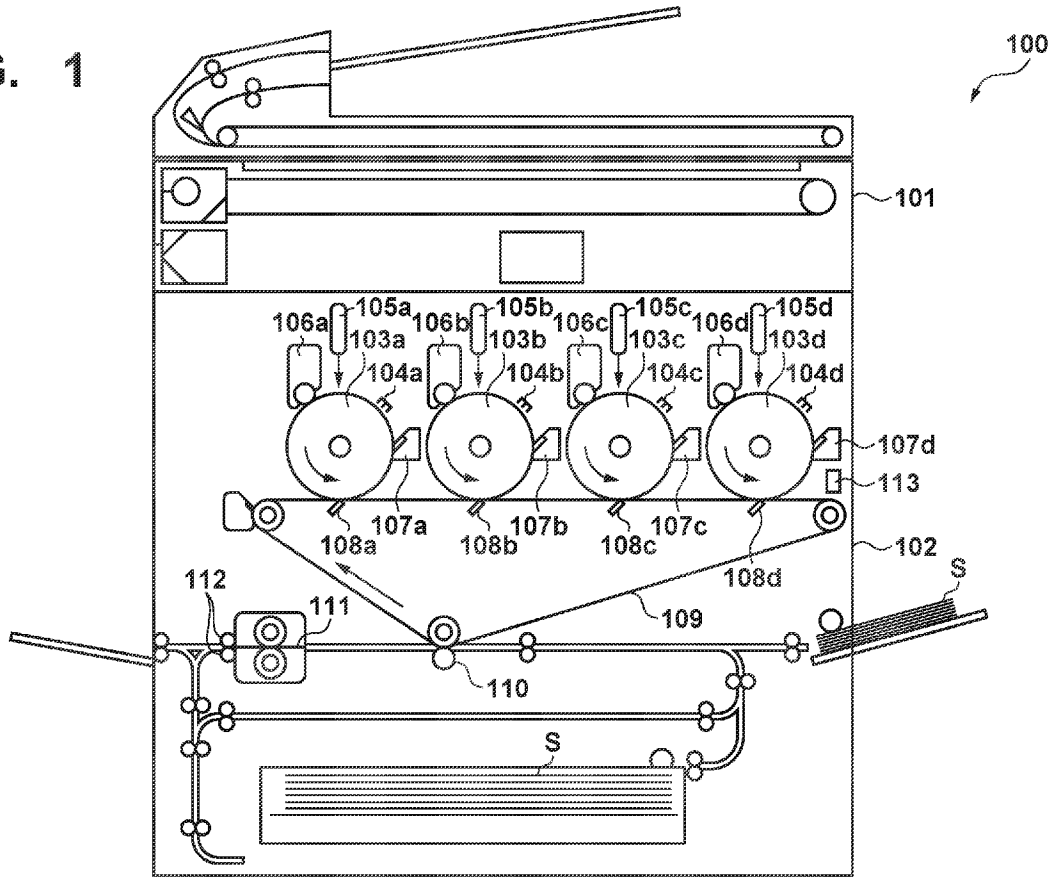
FIG. 1 is a configuration diagram of an image forming apparatus.

FIG. 1 is a configuration diagram of an image forming apparatus 100 according to this embodiment. In FIG. 1, the letters a, b, c, and d at the end of a reference numeral indicate that the color of the toner image related to formation by the corresponding member is yellow (Y), magenta (M), cyan (C), or black (Bk) respectively. Note, in the following description, reference numerals are used excluding these letters at the end in a case when it is not necessary to distinguish the color. An original reading unit 101 generates image data by reading an image of an original, and an image forming unit 102 forms the image on a recording medium based on the image data that the original reading unit 101 generated. Note, the image forming unit 102 can also form an image based on image data received via an external apparatus or a communication network in addition to the image data that the original reading unit 101 generated.

A photosensitive member 103 which is an image carrier is rotated in the direction of the arrow in the figure at a time of image formation. A charging unit 104 causes the surface of the photosensitive member 103 to be charged to a uniform electric potential. An exposure unit 105 forms an electrostatic latent image by exposing the charged photosensitive member 103 by a light. A developing unit 106 forms a toner image by developing an electrostatic latent image by toner. A transfer blade 108 transfers the toner image formed on the photosensitive member 103 to an intermediate transfer belt 109 by outputting a transfer bias. A cleaning unit 107 removes toner that remains on the photosensitive member 103. Note, the photosensitive member 103, the charging unit 104, the exposure unit 105, the developing unit 106, and the cleaning unit 107 configure an image forming station.

The intermediate transfer belt 109, which is an image carrier and an intermediate transfer body, is rotated in the direction of the arrow in the figure at a time of image formation. Accordingly, a toner image transferred from each photosensitive member 103 is conveyed to a position facing a roller 110 by a rotation of the intermediate transfer belt 109. The roller 110 outputs a transfer bias to transfer a toner image to a recording medium S conveyed through a conveyance path. The recording medium S is also called a sheet. After this, the recording medium S on which the toner image is transferred is conveyed to a fixing unit 111. The fixing unit 111 causes the toner image on the recording medium S to be fixed by heating/pressing the recording medium S. The recording medium S on which the toner image fixing process is performed is discharged to the outside of the apparatus by a discharge roller 112 or the like. An optical sensor 113 detects a detection pattern in color misregistration correction control described later.

Figure 5:
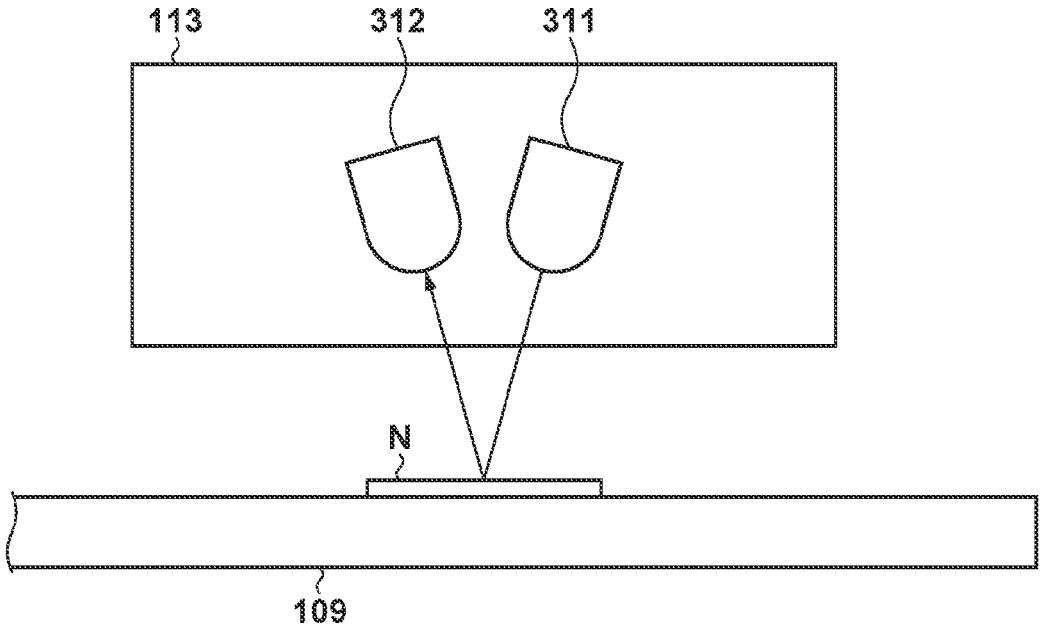
FIG. 5 is a configuration diagram of an optical sensor.

FIG. 5 is a configuration diagram of the optical sensor 113. A light emitting unit (light emitting element) 311 is an emitting unit that emits a light to the intermediate transfer belt 109. A light receiving unit (light receiving element) 312 receives a reflected light of light that the light emitting unit 311 emitted. The optical sensor 113 may detect specular reflection light and may detect diffused reflection light (diffuse reflected light). It is assumed that the specular reflection light is detected in the present embodiment. Thus, a light receiving unit 312 is arranged so that specular light reflected by the intermediate transfer belt 109 of the light that the light emitting unit 311 emits is received.

In the image forming apparatus 100, a color image is formed on the intermediate transfer belt 109 by each color of the toner images formed on the respective photosensitive members 103 being transferred so as to be superimposed on the intermediate transfer belt 109. However, a color misregistration occurs when the position of each toner image shifts from an ideal position when transferring to the intermediate transfer belt 109. Accordingly, the image forming apparatus 100 forms a detection pattern on the intermediate transfer belt 109 and performs color misregistration correction control based on a detection result of the detection pattern at a predetermined timing. The detection pattern is an image for measurement that includes each color used in image formation. Here, the predetermined timing is a time of a power supply activation of the image forming apparatus 100, a time of returning from a standby state, a time when a number of image forming materials from a color misregistration correction of a previous time reaches a predetermined value, or the like, for example.

Figure 2:
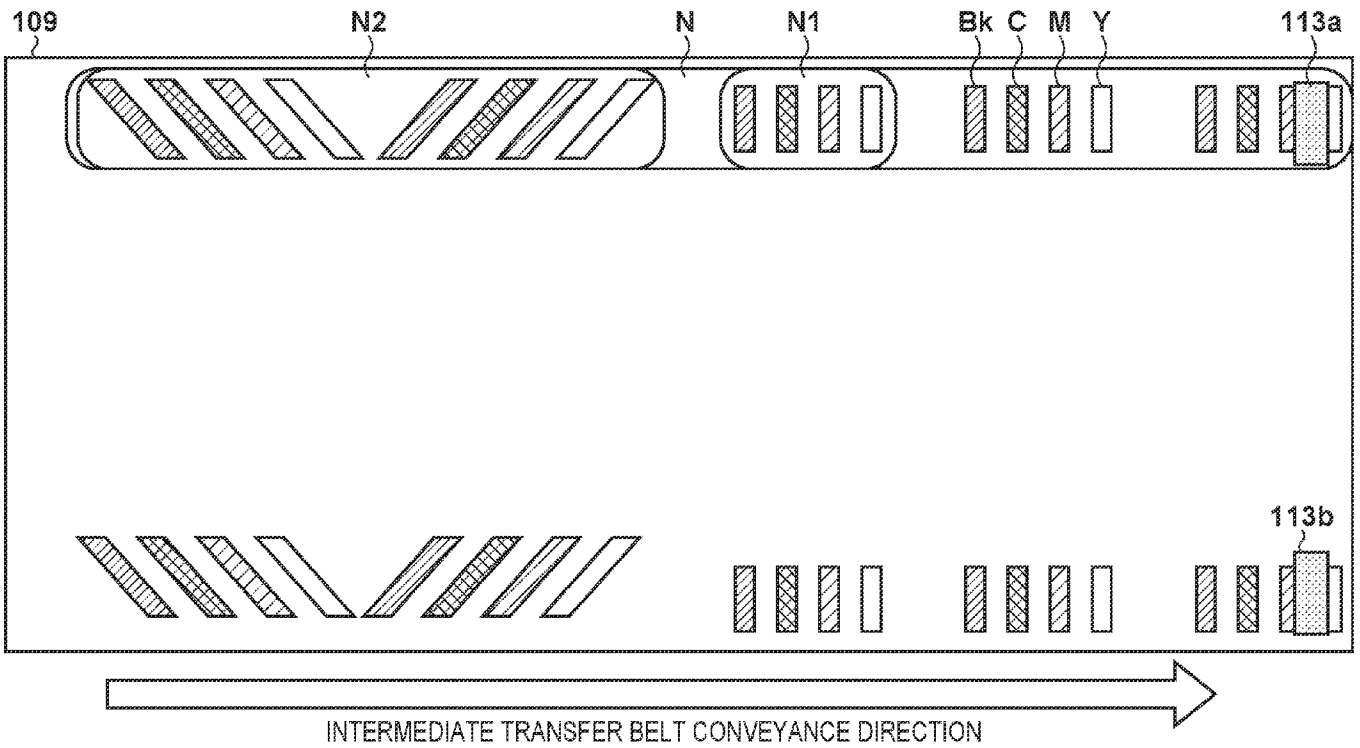
FIG. 2 is a view illustrating a detection pattern.

FIG. 2 is a schematic view of a detection pattern N formed on the intermediate transfer belt 109. The detection pattern N is transferred onto the intermediate transfer belt 109 from the photosensitive members 103 corresponding to the respective colors. Note, toner images of each color are formed on the edges in a main scanning direction on the intermediate transfer belt 109 in predetermined widths and intervals so as to not overlap. Here, the main scanning direction is a direction orthogonal to a conveyance direction of the intermediate transfer belt 109. The detection pattern N includes a detection pattern N1 for correcting a color misregistration of the sub scanning direction and a detection pattern N2 for correcting a color misregistration of the main scanning direction. Note, two optical sensors 113*a* and 113*b* are arranged corresponding to the detection pattern N formed on each edge of the intermediate transfer belt 109. Note, Bk, C, M, and Y indicate black, cyan, magenta, and yellow, respectively, in FIG. 2 and other figures.

Figure 3:
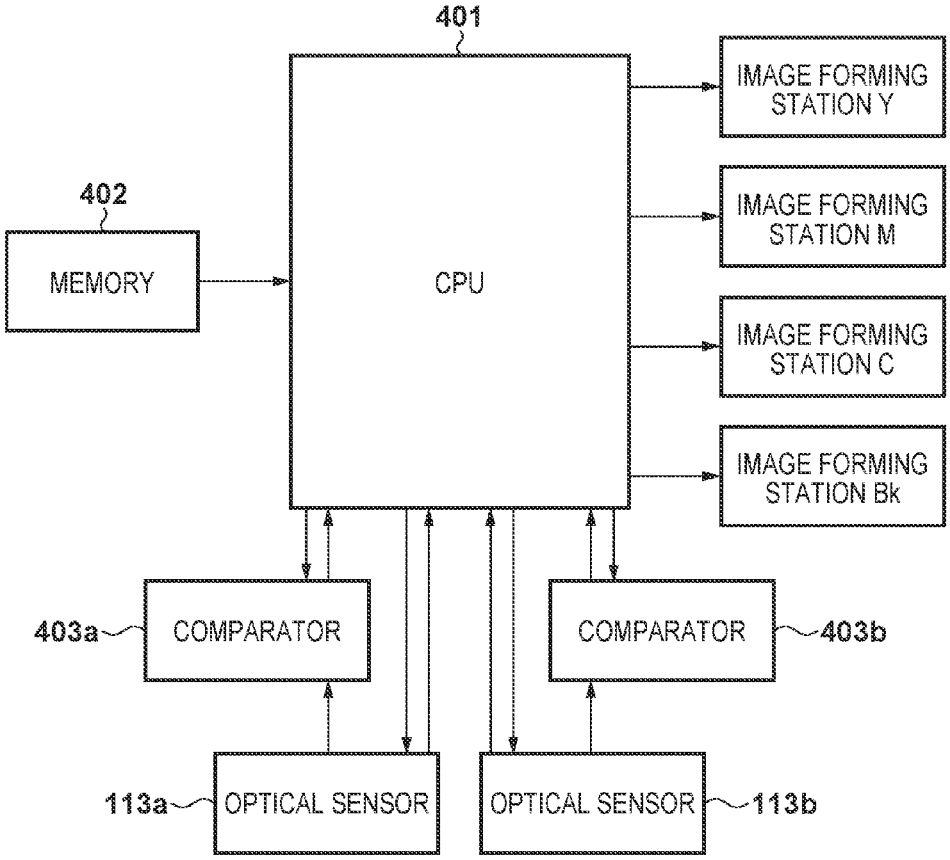
FIG. 3 is a control configuration diagram of an image forming apparatus.

FIG. 3 is a control configuration diagram of an image forming apparatus 100 according to this embodiment. A CPU 401 which is a control unit executes the color misregistration correction control by executing a program stored in a memory 402 which is a storage unit. An analog signal outputted from the optical sensor 113*a* is input to the CPU 401. Also, the analog signal is inputted to a comparator 403*a*. The comparator 403*a* compares an analog signal to a threshold value to thereby convert the analog signal to a digital signal and inputs the digital signal to the CPU 401. It is similar for an analog signal outputted from the optical sensor 113*b*. It is assumed that the optical sensors 113*a* and 113*b* are consolidated as the optical sensor 113 and comparators 403*a* and 403*b* are consolidated and may be called the comparator 403 in order to simplify the description hereinafter.

Figure 6:
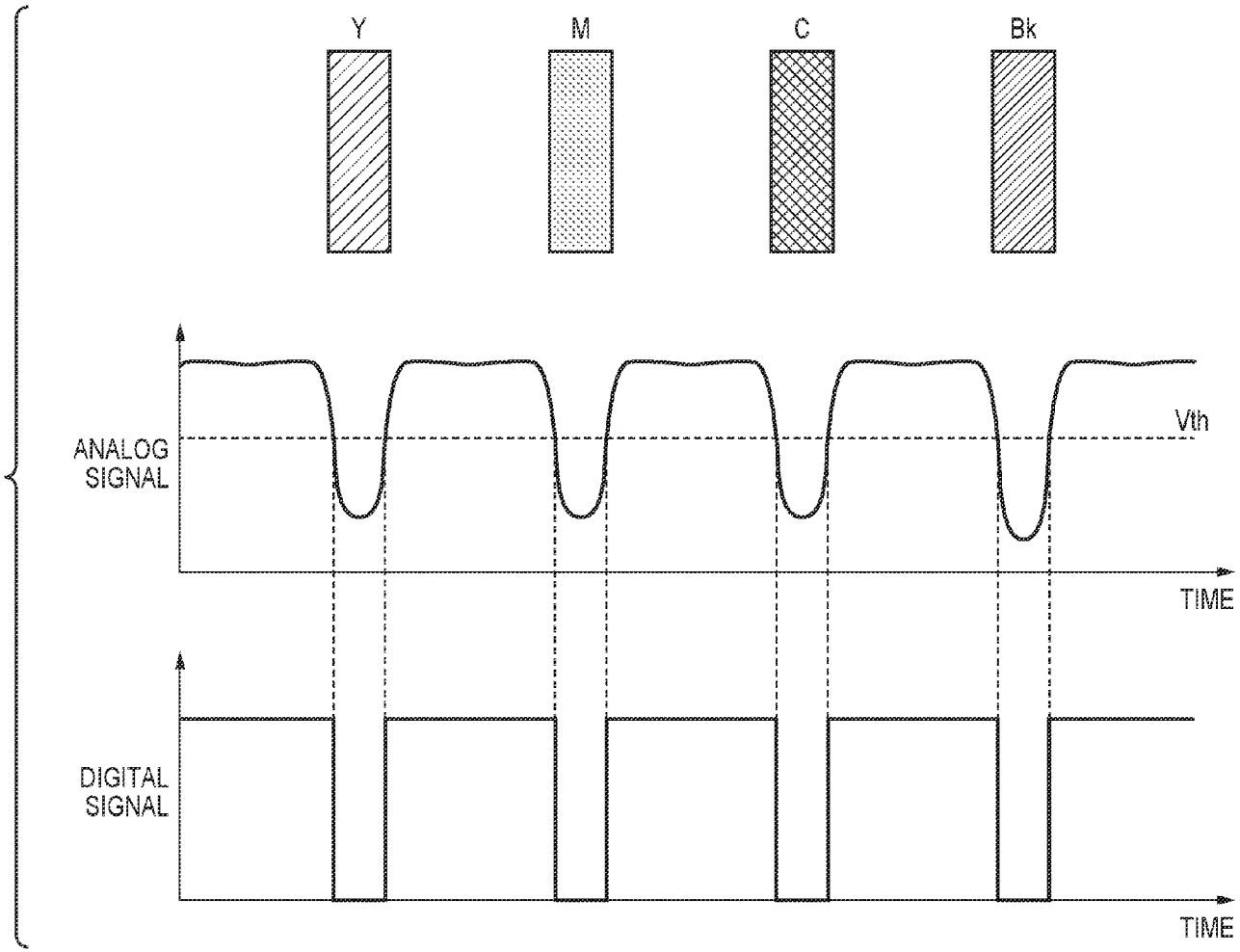
FIG. 6 is a view illustrating an analog signal outputted by an optical sensor and a digital signal based on this analog signal.

FIG. 6 illustrates waveforms of an analog signal which is an output signal that the optical sensor 113 outputs and of a digital signal outputted by the comparator 403 comparing the analog signal with a threshold value. The specular light reflected by the front surface of the intermediate transfer belt 109 is stronger than the specular light reflected by the detection pattern N. Accordingly, the level of the analog signal falls when the detection pattern N reaches the detection region of the optical sensor 113 as illustrated in FIG. 6. The comparator 403 outputs a high-level signal when the analog signal level is higher than the threshold value Vth, and outputs a low-level signal otherwise. Accordingly, the comparator 403 outputs the digital signal illustrated in FIG. 6 according to a relationship between the analog signal and the threshold value Vth illustrated in FIG. 6. The CPU 401 detects the position of each color of the toner image within the detection pattern based on the digital signal, and by this obtains a relative amount of color misregistration of each color of the toner image and generates color misregistration correction conditions. The CPU 401 controls the image forming station of each color to perform an image formation so that the amount of color misregistration decreases based on these color misregistration correction conditions.

Figure 4:
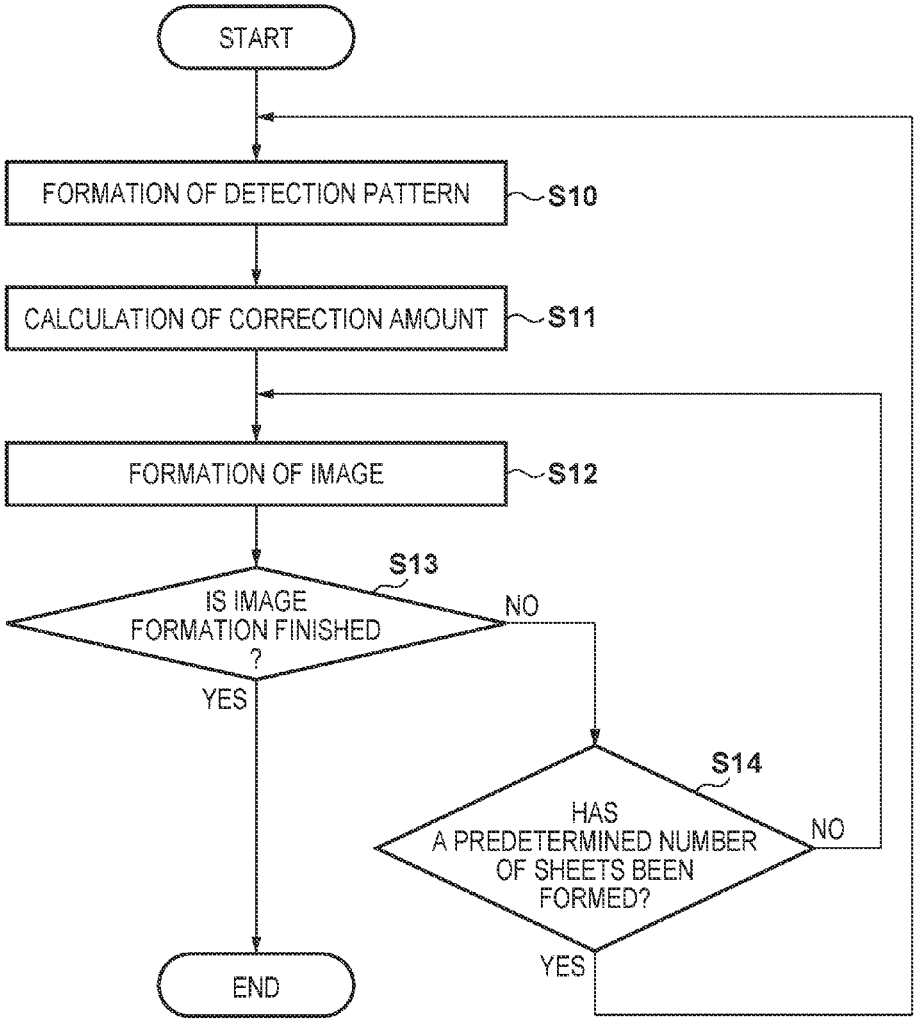
FIG. 4 is a flowchart of color misregistration correction control.

FIG. 4 is a flowchart of color misregistration correction control that the CPU 401 executes. Note, FIG. 4 illustrates a flow in a case when the image forming apparatus 100 in a standby state returns from the standby state and performs an image formation. Firstly, the CPU 401 controls each image forming station and forms the detection pattern N on the intermediate transfer belt 109 in step S10. The CPU 401 calculates an amount of color misregistration (amount of correction) in step S11 based on the output signal of the comparator 403. The CPU 401 performs image formation in step S12. Note, at this time it controls a timing of the light that the exposure unit 105 emits based on the amount of color misregistration calculated in step S11, and by this, causes a color misregistration to decrease, for example. The CPU 401 determines whether all images designated by the image data are formed on the recording medium in step S13. The CPU 401 ends the processing when all images are formed. Meanwhile, the CPU 401 determines whether or not a cumulative sheet count of recording mediums on which images are formed reaches a predetermined number of sheets in step S14 when all images are not yet formed. The CPU 401 forms an image in step S12 when the predetermined number of sheets is not reached. Meanwhile, the processing returns to step S10 and once again an amount of color misregistration is obtained when the predetermined number of sheets is reached. Note, only the processing of step S10 and step S11 of FIG. 4 is performed in cases when the color misregistration correction control is performed at a timing at which image formation is not performed such as at a time of the power supply activation. Also, the amount of color misregistration obtained in step S11 is recorded and is used in a subsequent image formation.

For example, the reflection intensity from the front surface of the intermediate transfer belt 109 becomes lower when paper dust or the like adheres to the front surface of the intermediate transfer belt 109 and the degree of reflection of the intermediate transfer belt 109 decreases overall. The detection pattern N becomes undetectable when the reflection intensity of the front surface of the intermediate transfer belt 109 is less than or equal to the threshold value Vth. Accordingly, the image forming apparatus 100 executes an intensity adjustment control for adjusting an emission intensity of the light emitting unit 311 at a predetermined timing, for example each time it forms an image on a predetermined number (cumulative sheet count) of sheets of recording mediums.

Figure 7A:
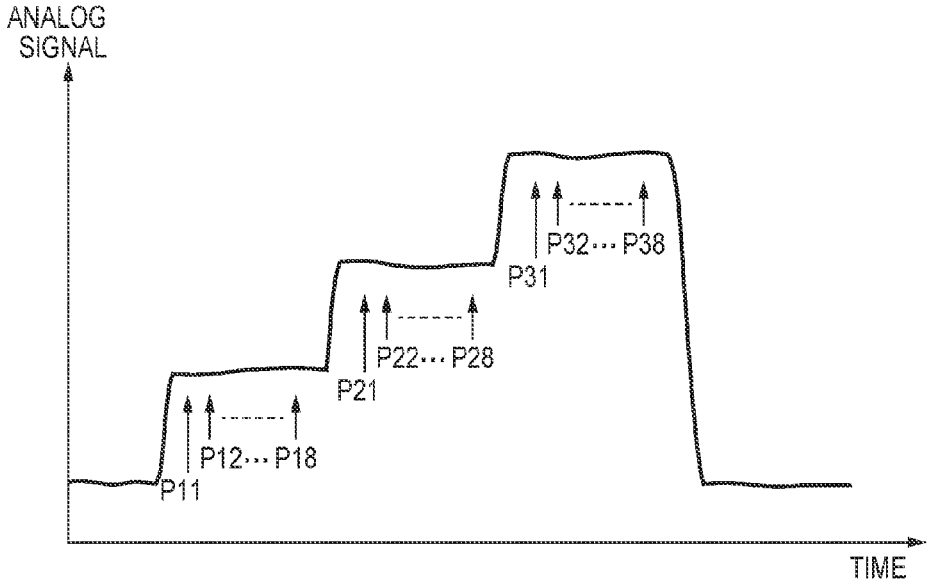
FIGS. 7A and 7B are explanatory views of an intensity adjustment control.
Figure 7B:
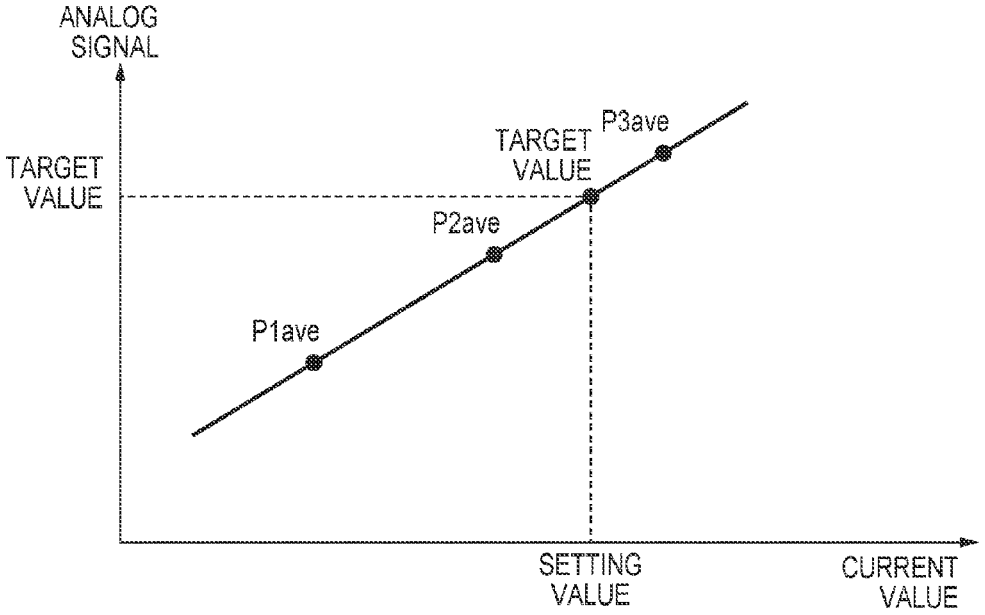

FIGS. 7A and 7B are explanatory views of an intensity adjustment control. The CPU 401 causes the light receiving unit 312 to detect the specular light reflected from the front surface of the intermediate transfer belt 109 and adjusts the emission intensity of the light emitting unit 311 based on a result of detection of the specular light reflected from the front surface of the intermediate transfer belt 109 in the intensity adjustment control. Note, as one example, the emission intensity of the light emitting unit 311 changes in three steps in the present embodiment. Note, the emission intensity of the light emitting unit 311 changes in accordance with a current value flowing to the light emitting unit 311. The abscissa of FIG. 7A is time and the ordinate indicates the level of an analog signal that the optical sensor 113 outputs. Note, signal levels P11 through P18 of FIG. 7A are values at which the level of the analog signal is sampled at eight points when the emission intensity is made to be a minimum. Also, signal levels P31 through P38 are values at which the level of the analog signal is sampled at eight points when the emission intensity is made to be a maximum. Also, signal levels P21 through P28 are values at which the level of the analog signal is sampled at eight points when the emission intensity is made to be an intermediate value. The CPU 401 causes the light emitting unit 311 to emit at each emission intensity and calculates an average value of the level of the analog signal outputted from the light receiving unit 312. Here, it is assumed that the average value of signal levels P11 through P18 is P1ave, the average value of signal levels P21 through P28 is P2ave, and the average value of signal levels P31 through P38 is P3ave. The CPU 401 performs linear interpolations on the average values P1ave, P2ave, and P3ave, and calculates an emission intensity at which the level of the analog signal becomes a target value, in other words, calculates the current that flows to the light emitting unit 311 as a setting value as illustrated in FIG. 7B.

Figure 8:
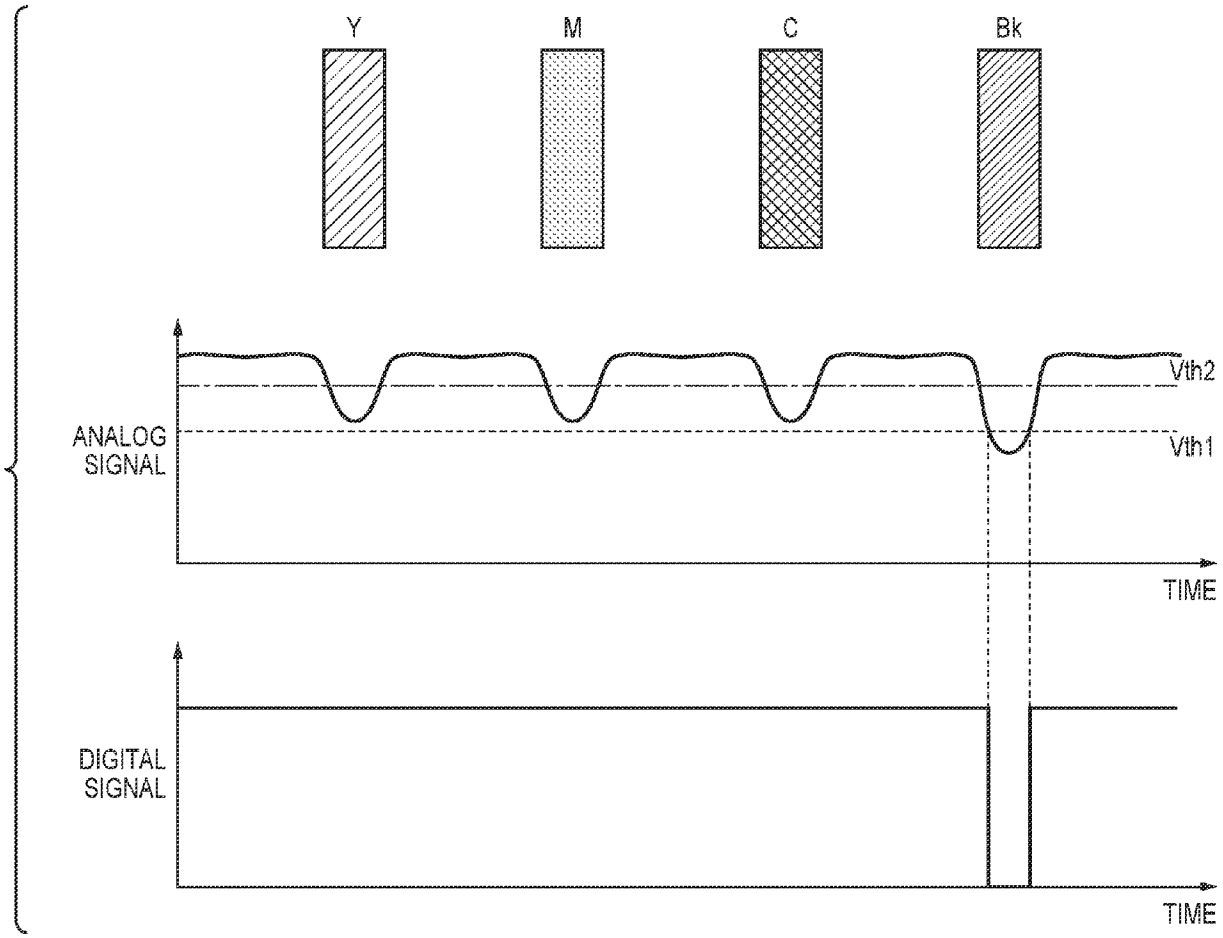
FIG. 8 is a view illustrating an analog signal outputted by an optical sensor and a digital signal based on this analog signal.

FIG. 8 illustrates waveforms of an analog signal that the optical sensor 113 outputs and of a digital signal that the comparator 403 outputs when the degree of reflection by the front surface of the intermediate transfer belt 109 is decreased. The level of the analog signal is kept to a target value when the light reflected from the front surface of the intermediate transfer belt 109 is detected according to the intensity adjustment control described above. However, by adjusting the emission intensity of the light emitting unit 311 in order to compensate for a decrease in the degree of reflection of the front surface of the intermediate transfer belt 109, the level of the analog signal when the light reflected from the detection pattern N is received also ends up being high. In other words, the level difference of the analog signal when the light reflected from the front surface of the intermediate transfer belt 109 is received and when the light reflected from the detection pattern N is received becomes small. Accordingly, the detection pattern N cannot be correctly detected as illustrated in FIG. 8 when converting the analog signal to the digital signal at a threshold value Vth1 prior to performing the intensity adjustment control. It is necessary that the threshold value be Vth2 in FIG. 8 in order to correctly detect the detection pattern N from the analog signal shown in FIG. 8. In other words, it is necessary to update the threshold value when the intensity adjustment control is executed.

Figure 9:
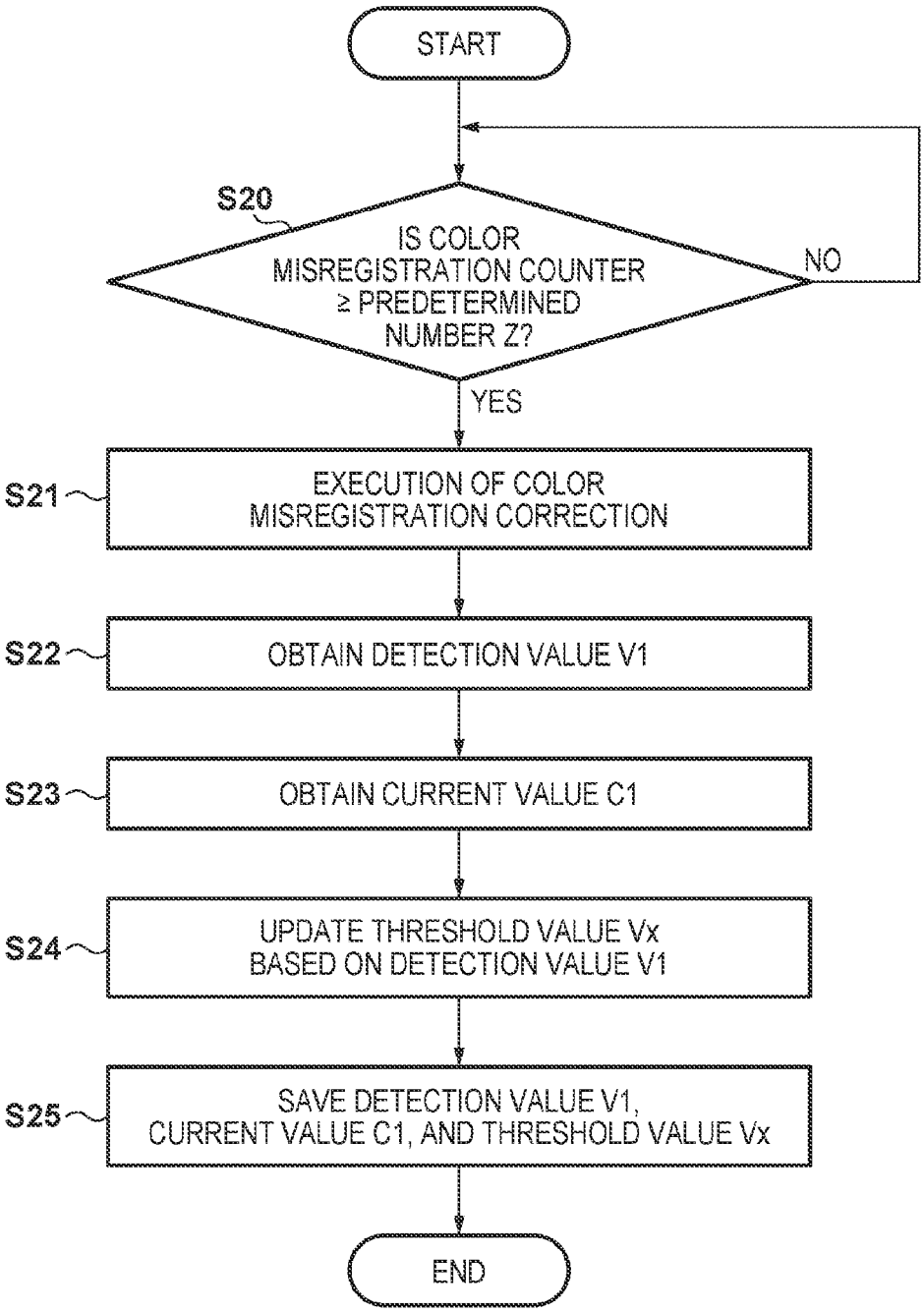
FIG. 9 is a flowchart of threshold value update processing at a time of color misregistration correction control.

Accordingly, the CPU 401 updates the threshold value after performing the color misregistration correction control or the intensity adjustment control. Firstly, description is given using FIG. 9 regarding threshold value update processing in the color misregistration correction control. In step S20, the CPU 401 waits until a color misregistration counter is greater than or equal to a predetermined number Z. Here, the color misregistration counter is a counted number of recording mediums S for which image formation is performed, and it resets to zero after executing the processing of FIG. 9. The CPU 401 forms a detection pattern N and performs the color misregistration correction processing in step S21 when the color misregistration counter is greater than or equal to the predetermined number Z. Note, the threshold value used by the color misregistration correction processing in step S21 is decided by the previous threshold value update processing. The CPU 401, in step S22, obtains the level of the analog signal that the optical sensor 113 outputted as a detected value V1 when the optical sensor 113 receives the light reflected from the pattern N for detection. Subsequently, the CPU 401 obtains the emission intensity of the light emitting unit 311 when the light receiving unit 312 receives the light reflected from the detection pattern N in step S23. Specifically, it obtains a current value C1 flowing to the light emitting unit 311. Also, the CPU 401 calculates a threshold value Vx according to equation (1) below after an update based on the detected value V1 in step S24.

$$Vx=(X-V1)\times P+V1 \quad (1)$$

Note, in equation (1), X is a target value of the level of the analog signal that the optical sensor 113 outputs when the light reflected from the front surface of the intermediate transfer belt 109 is received. Note, a detected value of the analog signal that the optical sensor 113 outputted when the light reflected from the front surface of the intermediate transfer belt 109 is received may be used as X in the color misregistration correction control in place of the target value. Also, P is a predetermined calculation ratio and is a value that is larger than 0 but smaller than 1. For example, the threshold value is a value between the detected value V1 and the target value X when P is 0.5. Note, the current value C1 is obtained in step S23 because it is used in the threshold value update processing after an intensity adjustment described later. Accordingly, the CPU 401 saves the detected value V1, the current value C1, and a post-update threshold value Vx to the memory 402 in step S25. Hereinafter, the CPU 401 uses the threshold value Vx saved in the storage unit to perform color misregistration correction control until it performs subsequent threshold value update processing.

Figure 10:
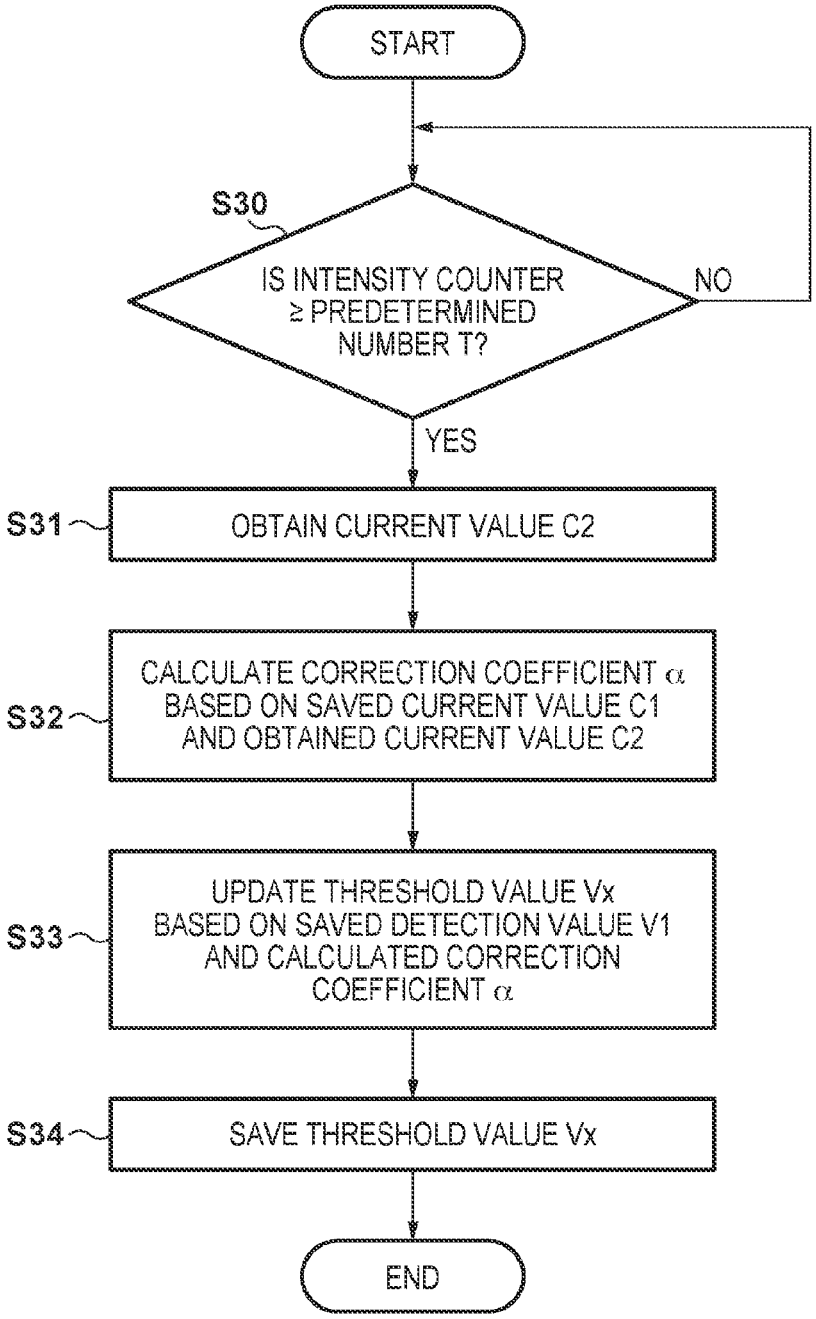
FIG. 10 is a flowchart of the threshold value update processing at a time of intensity adjustment control.

Next, description is given using FIG. 10 regarding the threshold value update processing after the intensity adjustment control. The CPU 401 waits until an intensity counter is greater than or equal to a predetermined number T in step S30. Here, the intensity counter is a counted number of recording mediums S for which image formation is performed, and it resets to zero after executing the processing of FIG. 10. Note, the predetermined number T from which an execution of the intensity adjustment control is determined is a value larger than the predetermined number Z from which an execution of the color misregistration correction is determined. In other words, it is assumed that a frequency of executions of the intensity adjustment control is less than a frequency of executions of the color misregistration correction. The CPU 401 obtains the emission intensity decided in the intensity adjustment control in step S31, in other words, obtains a current value C2 flowing to the light emitting unit 311. The CPU 401, in step S32, calculates a correction coefficient α as C2/C1 from the current value C2 obtained and the current value C1 recorded in the memory 402. Then, the CPU 401, in step S33, calculates the post-update threshold value Vx by equation (2) below based on the correction coefficient α and the detected value V1 recorded in the memory 402, and in step S34, saves the post-update threshold value Vx to the memory 402.

$$Vx=(X-\alpha\times V1)\times P+\alpha\times V1 \quad (2)$$

Note, X and P of equation (2) are the same as X and P in equation (1). The correction coefficient α is a ratio of an emission intensity after adjusting the intensity with respect to an emission intensity prior to adjusting the intensity, and more specifically is a ratio of an emission intensity after adjusting the intensity with respect to the emission intensity at a time of the color misregistration correction control. Accordingly, a correction coefficient α×V1 corresponds to an estimated value of the level of the analog signal when causing the light emitting unit 311 to emit at the intensity after the adjustment to receive light reflected from the detection pattern N. Accordingly, the post-update threshold value is a value between the level of analog signals when light reflected from the intermediate transfer belt 109 and the detection pattern N respectively is received after an intensity adjustment, when P is made to be 0.5, for example. Note, a timing of the execution of the intensity adjustment control and the threshold value update processing after this is determined based on the intensity counter in FIG. 10. However, the intensity adjustment control and the threshold value update processing thereafter can be configured to execute at a time of a power supply activation of the image forming apparatus or returning from a sleep mode in addition to or in place of execution based on the intensity counter.

As described above, the detected value V1 and the current value C1 are saved in the color misregistration correction control and are used to update a threshold value performed at a time of the intensity adjustment control. Accordingly, it is not necessary to measure the light reflected from the detection pattern and to form a detection pattern in the update of a threshold value performed at a time of the intensity adjustment control. By this configuration, the toner images of each color can be detected with good accuracy in the color misregistration correction control irrespective of a fluctuation due to various factors of the degree of reflection of the intermediate transfer belt 109. Note, the image forming apparatus transfers toner images formed on a plurality of photosensitive members to an intermediate transfer belt and transfers the toner images on the intermediate transfer belt to a recording medium in the above described embodiment. However, it is also possible that the image forming apparatus directly transfers the toner images formed onto the plurality of photosensitive members to a recording medium conveyed by a conveyer belt or the like. In such a case, the image forming apparatus forms a detection pattern in color misregistration correction control on the conveyer belt, for example. Accordingly, the toner images of each color can be detected with good accuracy in the color misregistration correction control irrespective of a fluctuation of the degree of reflection of the conveyer belt.

Also, a threshold value is always updated when the color misregistration correction control is applied in the above described embodiment. However, a configuration may be taken in which the threshold value is updated when the color misregistration correction control is applied a plurality of times because a decrease of the degree of reflection by the intermediate transfer belt 109 does not frequently occur. Furthermore, a configuration may be taken in which the threshold value is updated only after the intensity adjustment control. Also, a measured value of a current value is obtained as C1 in step S23 of FIG. 9 and saved in the above described embodiment. However, a configuration may be taken in which a value set by a previous intensity adjustment control is used as the current value C1 rather than obtaining the measured value of the current value in step S23.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-099051, filed on May 17, 2016, which is hereby incorporated by reference herein in its entirety.

What is claimed is:

1. An image forming apparatus comprising:

a plurality of image forming units configured to form images of different colors;

an intermediate transfer body, on which a detection image for detecting a color misregistration amount of the images of different colors is transferred;

a light emitting element configured to emit light for irradiating the intermediate transfer body;

a light receiving element configured to receive light reflected from the intermediate transfer body and to output an output value corresponding to an intensity of the reflected light;

a controller configured to control the plurality of image forming units to form the detection image, to control the light emitting element to emit light, to control the light receiving element to receive light reflected from the detection image, to compare a threshold value and an output value corresponding to an intensity of the light reflected from the detection image outputted by the light receiving element, and to detect the color misregistration amount based on a comparison result of the threshold value and the output value corresponding to the intensity of the light reflected from the detection image;

a correction unit configured to correct, based on the color misregistration, relative positions of images of the different colors to be formed by the plurality of image forming units;

an update unit configured to update the threshold value based on a previous output value corresponding to the intensity of the light reflected from the detection image outputted by the light receiving element; and an adjustment unit configured to control the light emitting element to emit light based on a plurality of emission intensities, to control the light receiving element to receive light reflected from the intermediate transfer body, to obtain a plurality of output values corresponding to the intensity of the light reflected from the intermediate transfer body outputted by the light receiving element, and to adjust an emission intensity of the light emitting element based on the plurality of output values, wherein the update unit updates, in a case when the emission intensity is adjusted by the adjustment unit, the threshold value based on the previous output value corresponding to the intensity of the light reflected from the detection image outputted by the light receiving element, a previous emission intensity, and the emission intensity adjusted by the adjustment unit.

2. The image forming apparatus according to claim 1, further comprising:

a memory configured to store the output value corresponding to the intensity of the light reflected from the detection image outputted by the light receiving element.

3. The image forming apparatus according to claim 1, wherein the update unit, in a case when the emission intensity is adjusted by the adjustment unit, obtains a ratio between the previous emission intensity and the emission intensity adjusted by the adjustment unit and updates the threshold value based on the previous output value and the ratio.

4. The image forming apparatus according to claim 3, wherein the update unit, in a case when the emission intensity is adjusted by the adjustment unit, decides an output value, the output value corresponding to an intensity of light reflected from the detection image outputted by the light receiving element after the emission intensity is adjusted, based on the ratio and the previous output value, and updates the threshold value based on the decided output value and a reference value.

5. The image forming apparatus according to claim 4, wherein the threshold value updated by the update unit is included in a range from the output value to the reference value, the output value corresponding to the intensity of light reflected from the detection image outputted by the light receiving element after the emission intensity is adjusted.

6. The image forming apparatus according to claim 1, wherein the plurality of emission intensities includes a first emission intensity and a second emission intensity different from the first emission intensity, and the adjustment unit adjusts the emission intensity of the light emitting element based on the plurality of output values such that an output value corresponding to the intensity of the light reflected from the intermediate transfer body outputted by the light receiving element becomes a reference value.

* * * * *